US008763417B2

(12) United States Patent
Szutu

(10) Patent No.: US 8,763,417 B2
(45) Date of Patent: Jul. 1, 2014

(54) WATER COOL REFRIGERATION

(76) Inventor: Hui Jen Szutu, San Gabriel, CA (US)

( * ) Notice: Subject to any disclaimer, the term of this patent is extended or adjusted under 35 U.S.C. 154(b) by 1055 days.

(21) Appl. No.: 11/985,158

(22) Filed: Nov. 14, 2007

(65) Prior Publication Data

US 2009/0120121 A1 May 14, 2009

(51) Int. Cl.
*F28D 5/00* (2006.01)
*F25B 47/00* (2006.01)
*F25B 39/04* (2006.01)

(52) U.S. Cl.
USPC ..... 62/305; 62/279; 62/506; 62/181

(58) Field of Classification Search
USPC ..... 62/305, 279, 506, 181
See application file for complete search history.

(56) References Cited

U.S. PATENT DOCUMENTS 4,136,528 A * 1/1979 Vogel et al. ..... 62/174
4,676,071 A * 6/1987 Latimer ..... 62/115
4,766,737 A * 8/1988 Baxter, II ..... 62/279
5,946,932 A * 9/1999 Wang ..... 62/305
5,966,958 A * 10/1999 Maynard ..... 62/277
2002/0073720 A1* 6/2002 Bourne et al. ..... 62/171
2004/0069001 A1* 4/2004 Taylor et al. ..... 62/238.1
2007/0283711 A1* 12/2007 Steinriede ..... 62/305
2010/0083676 A1* 4/2010 Merritt ..... 62/93
2010/0242534 A1* 9/2010 Stockton, Jr. ..... 62/516
2011/0048038 A1* 3/2011 Merritt et al. ..... 62/93
2012/0125036 A1* 5/2012 Lin ..... 62/426
2013/0098091 A1* 4/2013 Stephens et al. ..... 62/247

FOREIGN PATENT DOCUMENTS

EP 961092 A1 * 12/1999 ..... F25B 39/04

* cited by examiner

*Primary Examiner* — Frantz Jules
*Assistant Examiner* — Martha Tadesse

(57) ABSTRACT

The refrigeration system of this invention utilizes a water cooled condenser which is made of multiple water pans with refrigeration coil soldered underneath for multi-stages cooling. The water pans are stacked on top of each other with the hottest coil located at the bottom. The bottom water pan dries up water faster than the other water pans since it has the hottest coil soldered underneath. Once the water level of the bottom water pan is low enough to be refilled, the supply water fills in from the top water pan and propagating downward to the water pan down below until it reaches the water pan at the bottom. The water refilling ceases once the bottom water pan is full. The unwanted heat from a refrigeration system is transferred from the refrigerant to the water, and then from the water to the air by evaporation.

2 Claims, 5 Drawing Sheets

WATER COOL REFRIGERATION

BACKGROUND OF THE INVENTION

This invention relates to an evaporative condenser which is equipped to refrigeration or air-conditioning systems using water instead of air to cool the hot refrigeration coil by transferring heat from the hot refrigerant to the cooling water in multiple cooling stages. The water absorbs heat to make water vaporize into the air in a process known as evaporation, which is a natural physical phenomenon where water absorbs heat energy to change water from the liquid phase to vapor phase, resulting in a lower temperature. The beauty of this natural phenomenon is that the evaporation is able to lower the temperature of the said vapor departure spot below the ambient temperature. The temperature decrease is small, but provides a major advantage over air cooled since air cool condenser can never get lower than the ambient temperature.

Evaporative condensers have an excellent cooling capacity, which translates into significant energy saving. For example, lowering the temperature by 13° F. of the condensing unit of a 10 SEER conventional air condition systems can reduce the power consumption by as much as 20%. This energy saving goal can be easily achieved by the systems equipped with evaporative condensers. Few will deny the superiority of evaporative condensers over the popular air cool condensers. In this case, it is our solemn duty to find out the reasons that the evaporative condensers have no place in the refrigeration and air-conditioning application. Other than the higher energy efficiency, something else must be missing. Indeed, two major drawbacks are: (1) evaporative condensers do not last too long, (2) proper maintenance of evaporative condensers is difficult.

The life of an evaporative condenser is unexpectedly short, due to the fact that the evaporative condensers have direct contact with the cooling water. For example, water is directly sprayed on the evaporative condenser by a nozzle as illustrated by U.S. Pat. No. 4,974,422, and the evaporative condenser is covered by the wet absorptive material as illustrated by U.S. Pat. No. 6,286,325. The evaporative condenser is consistently wet with water and exposed to air (oxygen) which creates a corrosive environment for metal. Under this condition, the refrigeration tubing made of copper and the evaporative condensers made of other metals will rust. The rust will be able to totally breakdown the evaporative condenser in about two years. The energy saved does not pay off the cost of a new unit in two years.

The other drawback of evaporative condensers is that the quickly depositing scale decreases the heat transfer rate. Unattendance to the scale deposit problem could lead to system failure. Yet, there is little or no help from the current design to solve the scale deposit problem. U.S. Pat. No. 4,974,422 states: "The spray of a relatively large volume of cooling water washes away scale which would build up due to evaporation . . . . " This method does not work since scale is the byproduct of evaporation. More water may make more scale counterproductively. Removing scale out from a condensing coil is a high level difficulty job, due to the fact that the scale deposit into a coil is not in an area easily accessible. Also not much force or chemical can be applied to a refrigeration coil to remove scale. It is very hopeless to clean scale out from a condenser. The best remedy to this problem is not to allow scale deposit into the refrigeration coil.

The present invention does not allow the cooling water to directly contact the refrigeration coils, so no scale can be deposited into the condensing coils. Evaporation takes place in the water pans with non-stick coating. Scale deposited in the water pans is loose and can be easily removed anytime. Also, the cooling method of the present invention can significantly prolong the life of an evaporative condenser, which can last as long as the other conventional air cool condensers.

SUMMARY OF THE INVENTION

The evaporative condenser of the present invention can be conveniently installed anywhere whether it is indoor or outdoor. Regardless of location, the evaporative condenser will eject all unwanted heat from a condensing coil to assure no heat will re-enter the refrigeration system to make the compressor pump the same heat over again.

One object of the invention is to provide a condensing unit of refrigeration and air-conditioning systems which do not need to be remotely installed outdoor. The evaporative condensers of the present invention can be installed anywhere in order to save on installation cost and to avoid poor heat removal condenser due to the improper location of a condensing unit. No heat will be re-pumped by a compressor significantly reducing power consumption and prolonging the life of a compressor.

Another object of the invention is to provide an evaporative condenser for the portable air-conditioning system where the hot refrigerant is cooled by water from a storage container, eliminating the flexible duct to vent hot air outside.

Another object of the invention is to provide an evaporative condenser which can last as long as the conventional refrigeration condenser. The hot refrigeration coil being cooled by water has the same effect as the refrigeration coil when submerged in water but without directly contacting the cooling water, preventing corrosion of the copper refrigeration tubing and the other metals make of the evaporative condenser.

A further object of the invention is to provide an evaporative condenser where the scale deposit can be easily removed because scale can only be deposited into the stainless water pans with non-stick coating. Scale loosens by itself in the water pans, so removing scale deposit of water pans in a regular interval is a regular cleaning job.

DESCRIPTION OF SPECIFIC EMBODIMENTS

Figure 1:
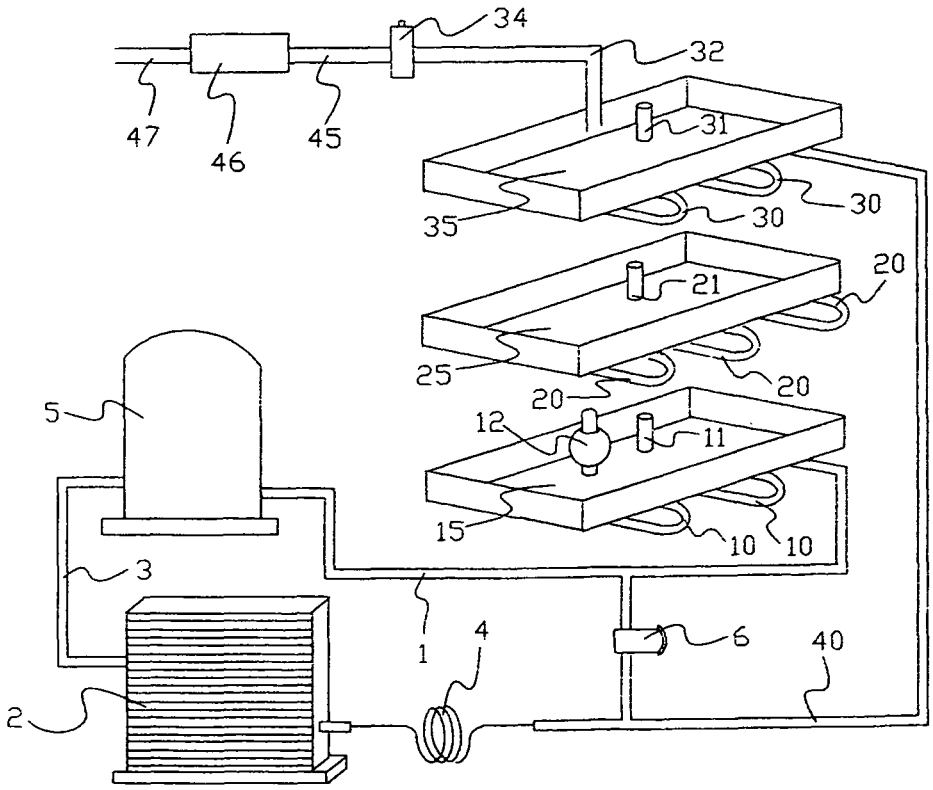
FIG. 1 is a perspective view for refrigeration system equipped with evaporative condenser cool by tap water.
Figure 4:
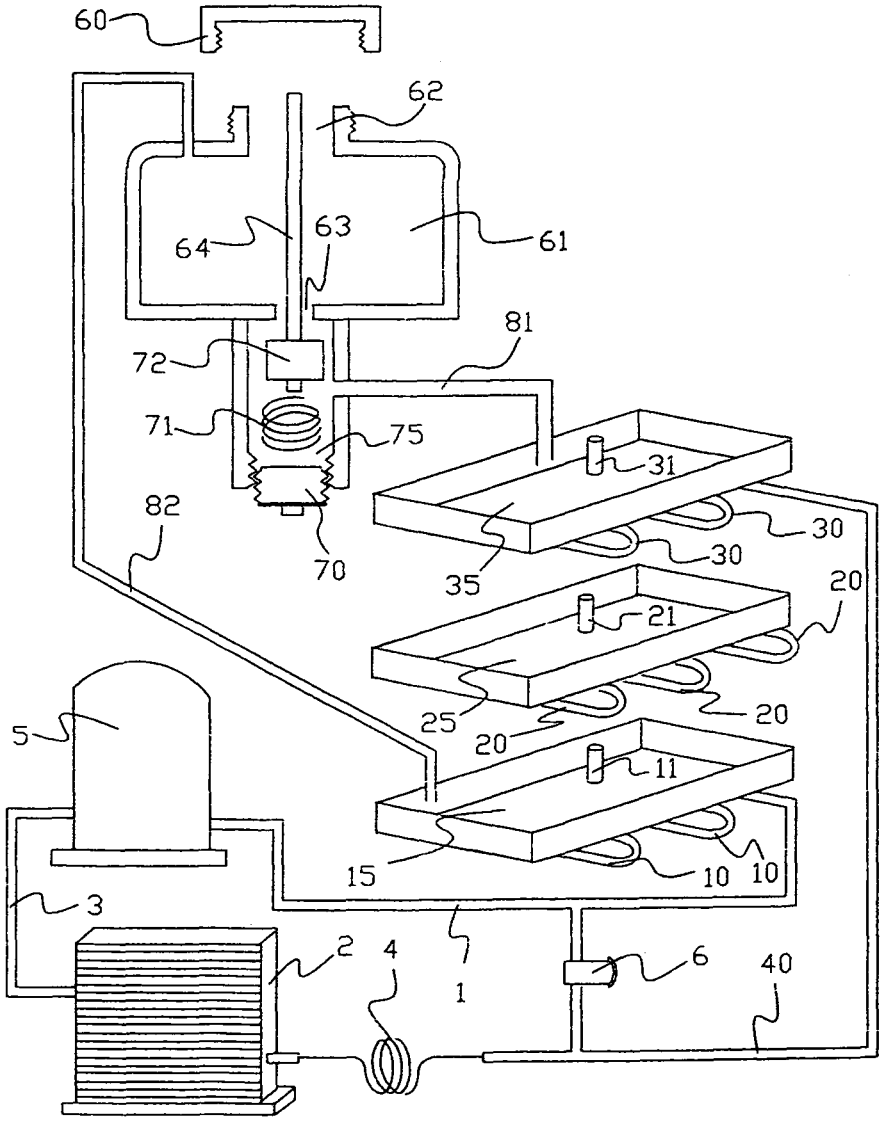
FIG. 4 is the perspective view for refrigeration system equipped with evaporative condenser cool by water from a storage container.

A compressor of a refrigeration system generates a lots of heat and all of this heat ideally needs to be ejected from the system before it goes back to the compressor for re-pumping. Referring to FIG. 1, and FIG. 4, the compressor 5 sucks refrigerant out from an evaporative coil 2, then the compressor 5 compresses the hot refrigerant to the condensing coil. The compressor discharge side 1 is piping the hot refrigerant to the first stage cooling coil 10 which is installed under the bottom water pan 15, then to the second stage cooling coil 20 which is installed under the middle water pan 25, and then to the final stage cooling coil 30 which is installed under the top water pan 35. The hot refrigerant ejects all the unwanted heat to the water in the water pans in different stages and the cooled refrigerant is piped to the input port 40 of the expansion valve 4. Due to the high efficiency of water cool, the refrigerant pressure may not be high enough for the expansion valve 4 to perform a proper expansion. In this case, the head pressure control valve 6 is open to let some of the hot refrigerant bypass the cooling stages to directly feed the expansion valve 4. The hot refrigerant mixes with the cooled refrigerant to make up the proper head pressure. The minimum head pressure is different for each application, the present invention set the head pressure for the R-22 air-conditioning unit to be 150 psi, which means that the head pressure control valve 6 is open when the head pressure is below the set pressure of 150 psi. The cooling stages may over cool which has to be adjusted by the head pressure control valve 6 to mix the hot and the cooled refrigerant to make the right head pressure ready for expansion.

The first stage cooling consumes most of the water since it absorbs most of the heat. The water in the bottom water pan 15 dries up faster than the water in the other two water pans 25 and 35 above. The refill of water to the water pans is monitored by the water level control located in the bottom water pan 15, but the supply water fills in from the top water pan 35. Once the top water pan 35 is full, water then goes down through the over-flow-tubing 31 to the middle water pan 25 below. Likewise, once the middle water pan 25 is full, water then goes down through the over-flow-tubing 21 to the bottom water pan 15. Once the bottom water pan 15 is full, the flow of water has to be turned off by two different methods under two different conditions, depending on whether the water supply is tap water or water from a storage container.

Figure 2:
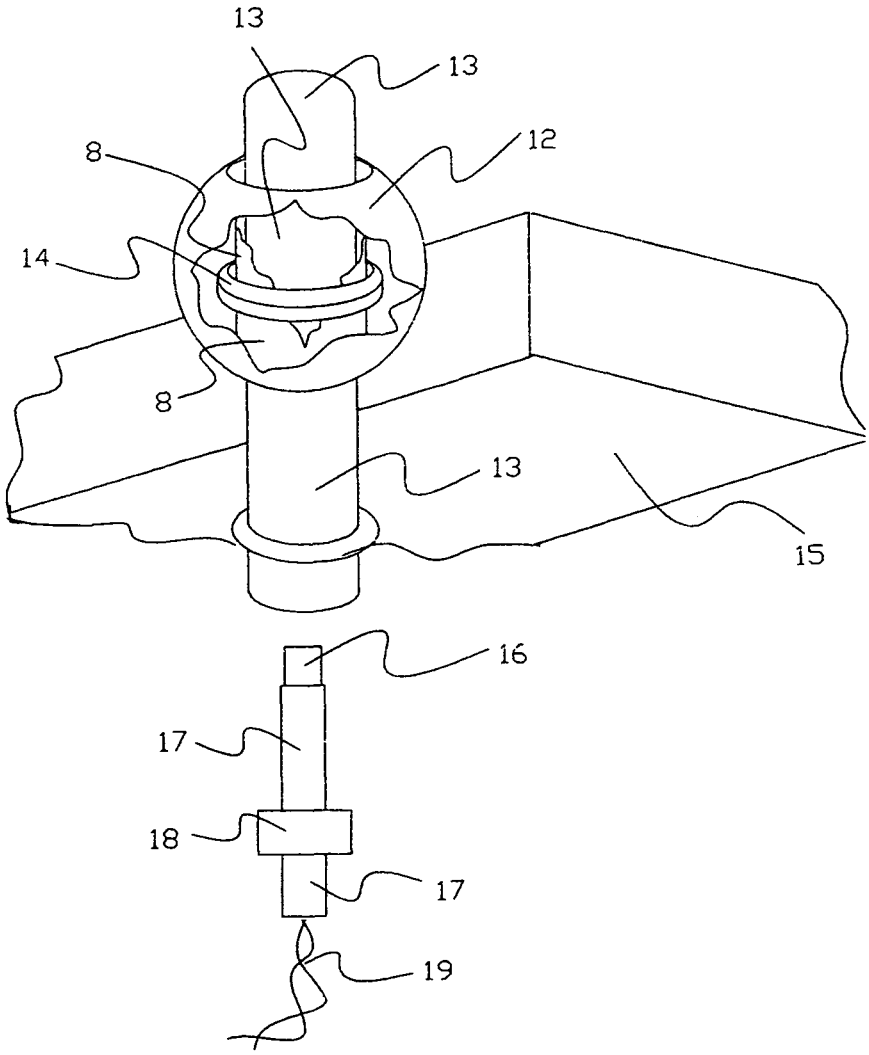
FIG. 2 is an exploded view of the water float
Figure 3:
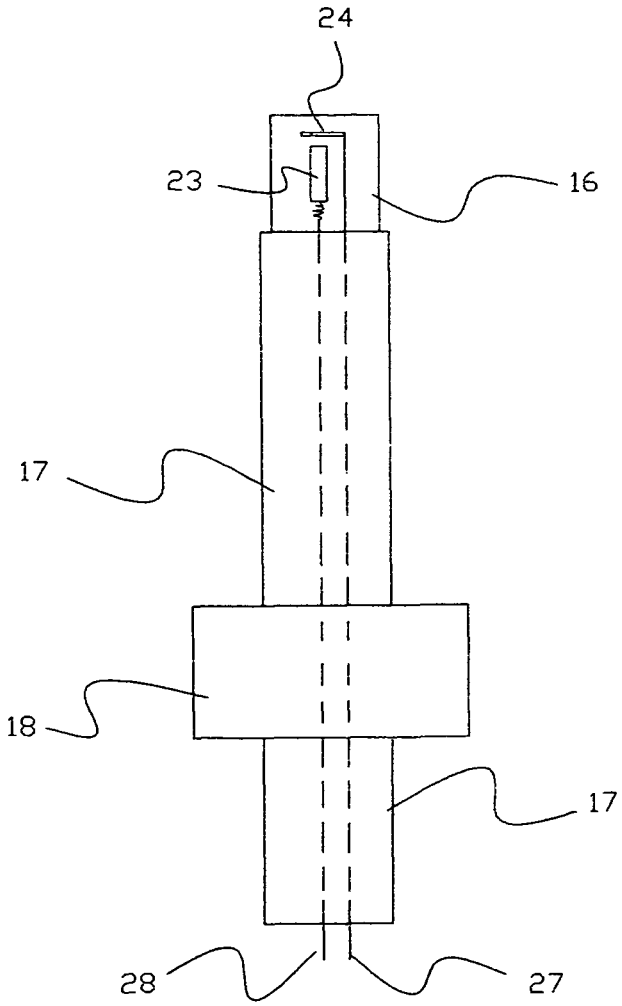
FIG. 3 is the detailed drawing of the float sensor components.

In the first case where water supply is directly from tap water, referring to FIG. 1, where water supply is connected to the filter inlet 47, the float 12 and the solenoid valve 34 are being used to control the water supply to the water pans. First, water has to be filtered by a scale eliminator 46 before entering to the water pans. The water float 12, also referring to FIG. 2 and FIG. 3, is made of a stainless hollow sphere with a ring magnet 14 located at the center of the sphere. The center hole of the ring magnet 14 is permanently fixed to the middle of the sphere axis 8 which is made of a hollow tubing 8. The two ends of the said hollow axis tubing 8 are stretched to the surface of the hollow sphere 12. The hollow tubing 8 is used to receive the stainless sensor housing 13, whereas the float sphere 12 is free to move up and down along the sensor housing 13 as a guiding track to make the hollow sphere 12 function as a water float.

The water supply to the water pans is initiated by the water level control in the bottom water pan. The float 12 with the ring magnet 14 works together with the float sensor 16 to turn on and off water solenoid valve 34. Referring to FIG. 2 and FIG. 3, the float sensor 16 is composed of two sensor leads 27 and 28, a contacting plate 24, a ferrous metal contactor 23, the sensor lead insulator 17 and a thread-able male coupling member 18 which can hold and slide along the sensor lead insulator 17 for water level adjustment. The float sensor 16 is inserted from the bottom up into the sensor housing 13. When the float 12 moves down to a position where the ferrous metal contactor 23 has settled within the inside of the center hole of the ring magnet 14, the said contactor 23 is pushed up by the magnetic force of the ring magnet 14 to make a direct contact with the contacting plate 24. At this point, the sensor leads 27 and 28 are connected as a switch in on position to turn on the water solenoid valve 34. Water flows into the water pans from the top water pan 35 to the bottom water pan 15 as mentioned above. As the water level rises in the bottom water pan 15, the float 12 is moving up until the contactor 23 is not longer inside the area of the center hole of the ring magnet 14. There is no magnetic force applied to the contactor 23, so the contactor 23 springs back to the position away from the contacting plate 24. The sensor leads 27 and 28 are disconnected and the water solenoid valve 34 shuts, thus water stops flowing.

In the second case that the cooling water is coming out from a storage container 61, as illustrated in FIG. 4. The refrigeration cycle under this condition remains the same as mentioned above. When the cap 60 is closed, the washer 72 is pushed down to open the siphon opening 63. The container 61 becomes siphon-able where water can siphon out from the storage container 61, through the siphon opening 63, washer housing 75, siphon hose 81 and then to the top water pan 35. The tip of the siphon hose 81 must be installed in the position much lower than the top opening of the over-flow-tubing 31 to ensure the tip of the siphon hose 81 is submerged in water at all time so that air will not enter the storage container 61 from the siphon hose 81. Once the top water pan 35 is full, water will flow down through the over-flow-tubing 31 to the middle water pan 25. Similarly, when the middle water pan 25 is full, the water goes down through the over-flow-tubing 21 to the bottom water pan 15. As the water flows out from the storage container 61, the outside air enters the storage container 61 from the breathing hose 82. The air goes inside the storage container 61 to maintain the atmospheric pressure inside the said container 61, which is required to continue the water flow. This process continues until the water level rises to the tip of the breathing hose 82. At this point, the tip of the breathing hose 82 is submerged by water, stopping air from going to the storage container 61 which creates a partial vacuumed condition inside the said storage container 61. Water cannot flow out from the water storage container 61 due to this partial vacuumed condition present inside the storage container 61.

Water starts flowing again from the water storage container 61 to the water pans 35, 25 and 15 as soon as the water level in the bottom water pan 15 goes below the tip of the breathing hose 82. The outside air is able to go to the storage container 61 from the breathing hose 82. The re-establishment of the atmospheric pressure inside the said container 61 allows the water to flow to the water pans again.

When the cap 60 is open during water refill, there should be no water siphon out from the storage container 61, since the pushing rod 64 is released from pushing down, the spring 71 freely push up the washer 72 to close the siphon opening 63. Open the cap 60 simultaneously close the siphon opening 63, consequently, no water allows flow out from the storage container 61.

All components connected to the storage container 61 should be installed in a leak-free condition other than the siphon-hose 81 and the breath hose 82. Particularly, closing the cap 60 and screwing in the plug 70 of the washer housing 75 shall be in a total leak-free condition, otherwise water will flow uncontrollably. The plug 70 provides a service access to the washer housing 75 for future maintenance and the over-flow tubing 11 of the bottom water pan 15 is connected to a drain pipe to prevent overflow.

Figure 5:
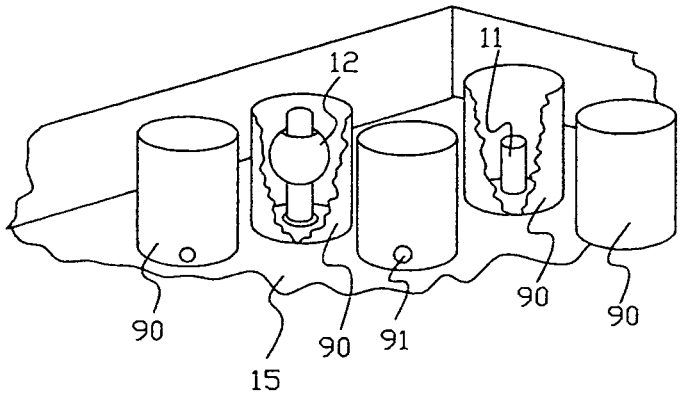
FIG. 5 is a perspective view for increasing evaporation surface by adding few thin wall cylinders inside the water pan.

As illustrated in FIG. 5, the thin sheet stainless steel cylinders 90 covered with absorptive material can be placed inside the water pans to increase the evaporative surface. Perforative holes 91 must be made to each cylinder to let water into and out of the cylinders. All the above mentioned water pans, water float, water level sensor housing are made of stainless steel with non-stick coating.

What is claimed is:

1. A refrigeration condenser, comprising:

multiple nonstick water pans stacked on top of each other;

each of said water pans having an overflow facility, said overflow facility providing drainage to either of a lower positioned water pan and a drain;

each of said water pans having high pressure refrigeration tubing attached to an underside of said water pan;

said high pressure refrigeration tubing containing refrigerant;

said refrigerant flowing upwardly from a bottom water pan to a top water pan;

a supply of water, said water originating from either of an outside water supply line and a water storage container and entering said top water pan and flowing downwardly to said bottom water pan, thereby refilling each of said water pans as said water cools said refrigerant and evaporates from said water pans; and said supply of water flowing in a direction opposite of said flow of said refrigerant.

2. The refrigeration condenser, as described in claim 1, further comprising:

a float switch located in the bottom water pan, said switch controlling a water level in said bottom water pan;

said float switch having a ring magnet which is housed inside a stainless steel sphere, said sphere being capable of floating in water;

a magnetic force of said ring magnet acting on a ferrous metal contactor as said floating sphere nears a bottom of the bottom water pan, closing an electrical contact, said contact turning on said supply of water to the top water pan, said supply of water being turned off when said sphere is raised in said bottom pan by incoming water and said electrical contact is opened.

* * * * *